US011490770B2

(12) United States Patent
Buchalter

(10) Patent No.: US 11,490,770 B2
(45) Date of Patent: Nov. 8, 2022

(54) NATURAL DISPOSABLE BAMBOO WIPES

(71) Applicant: Products On The Go, LLC, Delray Beach, FL (US)

(72) Inventor: Sharon Buchalter, Delray Beach, FL (US)

(73) Assignee: PRODUCTS ON THE GO, LLC, Delray Beach, FL (US)

( * ) Notice: Subject to any disclaimer, the term of this patent is extended or adjusted under 35 U.S.C. 154(b) by 294 days.

(21) Appl. No.: 16/691,473

(22) Filed: Nov. 21, 2019

(65) Prior Publication Data

US 2020/0154956 A1 May 21, 2020

Related U.S. Application Data

(60) Provisional application No. 62/770,622, filed on Nov. 21, 2018.

(51) Int. Cl.

| | |
|---|---|
| ***C11D 3/20*** | (2006.01) |
| ***C11D 3/382*** | (2006.01) |
| ***A47K 10/16*** | (2006.01) |
| ***B08B 1/00*** | (2006.01) |

(52) U.S. Cl.

CPC ..... *A47K 10/16* (2013.01); *B08B 1/006* (2013.01); *C11D 3/2079* (2013.01); *C11D 3/2086* (2013.01); *C11D 3/382* (2013.01)

(58) Field of Classification Search

CPC ..... C11D 3/20; C11D 3/2086; C11D 3/382; B08B 1/006; A47K 10/16

See application file for complete search history.

(56) References Cited

U.S. PATENT DOCUMENTS

2016/0310406 A1* 10/2016 Nebel ..... A01N 65/28

FOREIGN PATENT DOCUMENTS

WO WO 2017/197396 * 11/2017 ..... A61K 8/97

* cited by examiner

*Primary Examiner* — Brian P Mruk

(74) *Attorney, Agent, or Firm* — Workman Nydegger

(57) ABSTRACT

Disclosed are natural baby products and related methods of use. A natural disposable wipes comprised of all-natural materials. The natural disposable wipes may comprise a natural disposable wipe and a natural cleansing solution. The natural disposable wipes may be pre-moistened with the natural cleansing solution. The natural disposable wipes may be made from 100% biodegradable materials. Biodegradable materials may include bamboo fibers. The natural cleansing solution may be made from all-natural ingredients and may include a solvent, one or more preservatives, one or more skin conditioning agents, one or more antioxidants, and one or more astringents.

20 Claims, 1 Drawing Sheet

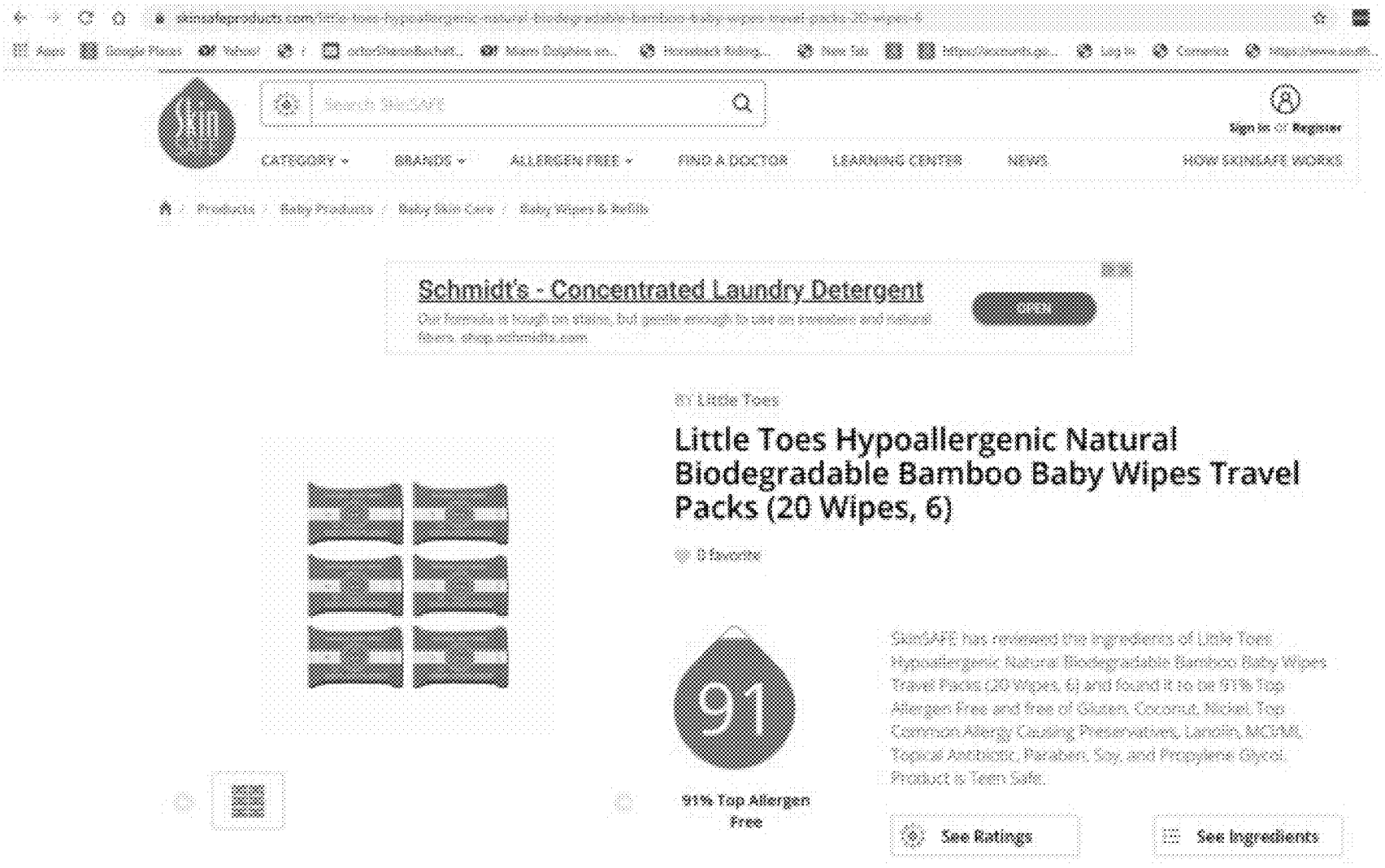
Schmidt's - Concentrated Laundry Detergent
Little Toes Hypoallergenic Natural Biodegradable Bamboo Baby Wipes Travel Packs (20 Wipes, 6)
91
See Ratings
See Ingredients

NATURAL DISPOSABLE BAMBOO WIPES

CROSS-REFERENCE TO RELATED APPLICATIONS

This application claims the benefit of and priority to U.S. Provisional Application No. 62/770,622, filed Nov. 21, 2018, the entirety of which is incorporated herein by references.

BACKGROUND

1. Technical Field

The present disclosure relates to disposable baby hygiene products, particularly disposable baby hygiene products made with natural, sustainable, environmentally-responsible, and/or biodegradable material(s). Specifically, the present disclosure relates to natural, disposable baby wipes made with bamboo and impregnated with a natural cleansing solution.

2. Related Technology

Ready-to-use cleaning products are a consumer favorite because they combine an application device and a cleaning solution into a single product. On-the-go cleaning products include wipes. A wet wipe, also known as a wet towel or a moist towelette, or a baby wipe in specific circumstances, is a small moistened piece of paper or plastic cloth that often comes folded and individually wrapped for convenience. Wet wipes are used for cleaning purposes like personal hygiene and household cleaning. Water companies warn people not to flush wet wipes down toilets, as their failure to break down or dissolve in water can cause sewer blockages known as fatbergs. Even wipes labeled "flushable" can cause blockages because they are not biodegradable.

Baby wipes are wet wipes used to cleanse the sensitive skin of infants. These are saturated with solutions anywhere from gentle cleansing ingredients to alcohol based 'cleaners'. Baby wipes are typically different pack counts (ranging up to 80 or more sheets per pack) and come with dispensing mechanisms.

Since the mid-2000s, wet wipes, such as baby wipes, have become more common for use as an alternative to toilet paper in affluent countries, including the United States and the United Kingdom. This usage has in some cases been encouraged by manufacturers, who have labelled some wet wipe brands as "flushable". Wet wipes, even "flushable" ones, when flushed down the toilet, have been known to clog internal plumbing, septic systems, and public sewer systems. The tendency for fat and wet wipes to cling together encourages the growth of the problematic obstructions in sewers known as 'fatbergs'. In addition, some brands of wipes contain alcohol, which can kill the bacteria and enzymes responsible for breaking down solid waste in septic tanks.

Accordingly, there are a number of disadvantages with baby wipes that can be addressed.

BRIEF DESCRIPTION OF THE DRAWINGS

Various embodiments of the present disclosure will be discussed with reference to the appended drawings. It is appreciated that the drawings depict only typical embodiments of the presents disclosure and are not to be considered limiting of its scope.

FIG. 1 is a copy of a webpage showing "SkinSAFE" certification of a natural, disposable, bamboo baby wipe product in accordance with one or more embodiments of the present disclosure.

BRIEF SUMMARY

Embodiments, implementations, and/or aspects of the present disclosure solve one or more of the foregoing or other problems in the art with disposable baby wipes made with natural, sustainable, environmentally responsible, and/or biodegradable material(s). Specifically, embodiments of the present disclosure include natural, disposable baby wipes made with bamboo and impregnated with a natural cleansing solution.

Embodiments can include a disposable baby wipe product, comprising a sheet material comprised of 100% biodegradable bamboo fibers and a cleansing solution, comprising *Aloe vera* (leaf and/or juice) (extract), *Cucumis sativus* (cucumber) (extract), *Chamomilla recutita* (chamomile) oil, citric acid, sodium citrate, tea tree oil, potassium sorbate, sodium benzoate, and water, the sheet material being impregnated with the cleansing solution. The sheet material can be substantially rectangular configuration, measuring approximately 15 cm×20 cm 1 mm.

The cleansing solution comprises 0.01-2%, w/w, *Aloe vera* (leaf and/or juice) (extract), preferably about 0.1%, w/w, *Aloe vera* (leaf and/or juice) (extract); 0.01-2%, w/w, *Cucumis sativus* (cucumber) (extract), preferably about 0.1%, w/w, *Cucumis sativus* (cucumber) (extract); 0.01-2%, w/w, *Chamomilla recutita* (chamomile) oil, preferably about 0.1%, w/w, *Chamomilla recutita* (chamomile) oil; 0.01-1%, w/w, citric acid, preferably about 0.08%, w/w, citric acid; 0.01-1%, w/w, sodium citrate, preferably about 0.05%, w/w, sodium citrate; 0.05-2%, w/w, potassium sorbate, preferably about 0.45%, w/w, potassium sorbate; 0.05-2%, w/w, tea tree oil, preferably about 0.3%, w/w, tea tree oil; 0.05-2%, w/w, sodium benzoate, preferably about 0.5%, w/w, sodium benzoate; and water, preferably purified water, q.s. to 100%.

Embodiments can include a disposable baby wipe product, comprising a natural disposable wipe, wherein the natural disposable wipe is comprised of biodegradable materials and wherein the natural disposable wipes are presoaked in a natural cleansing solution, the natural cleansing solution comprising a solvent; one or more skin conditioning agents; one or more preservatives; one or more antioxidants; and one or more astringents.

In some embodiments, all of the ingredients of the natural cleansing solution are derived from natural sources. The natural disposable wipe can be comprised of bamboo. The solvent can be or comprise purified water. The one or more skin conditioning agents can include tea tree oil, *chamomilla recutita*, and aloe barbadensis leaf juice. The one or more preservatives can include sodium benzoate, potassium sorbate, sodium citrate, and citric acid. The one or more antioxidants can include tea tree oil, *chamomilla recutita*, and aloe barbadensis leaf juice. The one or more astringents can include cucumber extract.

Embodiments can include a natural disposable wipe, comprising a natural disposable wipe comprised of 100% biodegradable materials, wherein the biodegradable material comprises bamboo fiber, and a natural cleansing solution, the natural cleansing solution comprising a solvent; one or more skin conditioning agents; one or more preservatives; one or more antioxidants; and one or more astringents, wherein all of the ingredients of the natural cleansing solution are derived from natural sources, and wherein the natural disposable wipe is presoaked in the natural cleansing solution and packaged to retain moisture.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of exemplary embodiments of the present disclosure will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

It is also noted that each of the foregoing, following, and/or other features described herein represent a distinct embodiment of the present disclosure. Moreover, combinations of any two or more of such features represent distinct embodiments of the present disclosure. Such embodiments can also be combined in any suitable combination and/or order without departing from the scope of this disclosure. Thus, each of the features described herein can be combinable with any one or more other features described herein in any suitable combination and/or order. Accordingly, the present disclosure is not limited to the specific combinations of exemplary embodiments described in detail herein.

DETAILED DESCRIPTION

Before describing various embodiments of the present disclosure in detail, it is to be understood that this disclosure is not limited to the specific parameters and description of the particularly exemplified systems, methods, and/or products that may vary from one embodiment to the next. Thus, while certain embodiments of the present disclosure will be described in detail, with reference to specific features (e.g., configurations, parameters, properties, steps, components, ingredients, members, elements, parts, and/or portions, etc.), the descriptions are illustrative and are not to be construed as limiting the scope of the present disclosure and/or the claimed invention. In addition, the terminology used herein is for the purpose of describing the embodiments, and is not necessarily intended to limit the scope of the present disclosure and/or the claimed invention.

While the detailed description is separated into sections, the section headers and contents within each section are not intended to be self-contained descriptions and embodiments. Rather, the contents of each section within the detailed description are intended to be read and understood as a collective whole where elements of one section may pertain to and/or inform other sections. Accordingly, embodiments specifically disclosed within one section may also relate to and/or serve as additional and/or alternative embodiments in another section having the same and/or similar systems, devices, methods, and/or terminology.

Abbreviated List of Defined Terms

To assist in understanding the scope and content of the foregoing and forthcoming written description and appended claims, a select few terms are defined directly below. Unless defined otherwise, all technical and scientific terms used herein have the same meaning as commonly understood by one of ordinary skill in the art to which the present disclosure pertains.

The terms "comprising," "comprise," "comprises," and similar terms, as used herein, including in the claims, shall be inclusive and/or open-ended and do not exclude additional, un-recited elements or method steps, illustratively. Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

As used herein, the transitional phrases "consisting of," "consist of," and similar terms shall be close-ended so as to exclude additional, un-recited elements or method steps, illustratively.

As used herein, the transitional phrase "consisting essentially of" means that the scope of a claim is to be interpreted to encompass the specified materials or steps recited in the claim, "and those that do not materially affect the basic and novel characteristic(s)" of the claimed invention. See, In re Herz, 537 F.2d 549, 551-52, 190 U.S.P.Q. 461, 463 (CCPA 1976) (emphasis in the original); see also MPEP § 2111.03. Thus, the term "consisting essentially of" when used in a claim of this disclosure is not intended to be interpreted to be equivalent to "comprising."

As used herein, the terms "about," "approximately," and similar terms, with regard to a value, mean +/−10% of the stated value or amount represented thereby. For instance, throughout the present disclosure, the term "about" is used in connection with a percent concentration or composition of a component or ingredient (e.g., in a composition, formulation, or mixture, such as a fluid or liquid mixture, aqueous mixture, solution, etc., optionally or preferably measured as a w/w percent, w/v percent, v/v percent, etc.). In such instance, the term "about" and/or the term "+/−10%" implies and/or includes +/−10% of the stated numeric value, as opposed to +/−10 percentage points of the recited percent. By way of example, where 20% w/w of a component or ingredient reflects 20 g of the component or ingredient per 100 mL of total mixture, the term "about" and/or the term "+/−10%" implies and/or includes a recited range from 18 g to 22 g (i.e., from 18% w/w to 22% w/w), not a range of 10% w/w to 30% w/w. Alternatives for so-called "about" values and/or +/−10% include +/−1%, +/−2%, +/−3%, +/−4%, +/−5%, +/−6%, +/−7%, +/−8%, or +/−9% of the stated value, each of which is contemplated as a suitable alternative to or substitute for the term "about" or the use of +/−10% herein.

It will also be appreciated that where two or more values, or a range of values (e.g., less than, greater than, at least, and/or up to a certain value, and/or between two recited values) is disclosed or recited, any specific value or range of values falling within the disclosed values or range of values is likewise disclosed and contemplated herein. Thus, disclosure of an illustrative measurement (e.g., volume, concentration, etc.) that is less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

As used herein, the term "substantially devoid," "substantially free," and similar terms mean (1) an undetectable or unquantifiable amount, (2) less than or below an amount generally considered by those skilled in the art to reflect a detectable or quantifiable amount, and/or (3) less than or below an amount generally considered by those skilled in the art to be functional or able to achieve a (desired or expected) result.

In at least one embodiment, the terms "form," "forming," and the like (e.g., "formed of," "formed with,"), as well as "made of" and "made with" are open-ended, such that sub-components that (are combined, mixed, or included together so as to) form a component (e.g., system, application, product, composition, mixture, ingredient, element, part, etc.) do not necessarily constitute the entire component. Accordingly, a product can be formed of, made of, formed with, or made with one or more components without, necessarily, consisting, either entirely or essentially, of said one or more components. Similarly, a component can comprise, be formed of, made of, formed with, or made with one or more sub-components, without, necessarily, consisting, either entirely or essentially, of said sub-components.

As used herein, the term "composition" includes products, formulations, and mixtures, as well as devices, apparatus, assemblies, kits, and so forth. Similarly, the term "method" includes processes, procedures, steps, and so forth. The terms "formulation" and "composition" may be used interchangeably herein, except where context clearly indicates otherwise.

As used herein, the term "method" also contemplates processes, procedures, steps, and so forth. Moreover, the term "products" also contemplates systems, compositions, kits, and so forth.

Various aspects of the present disclosure, including systems, methods, and/or products may be illustrated with reference to one or more embodiments or implementations, which are exemplary in nature. As used herein, the terms "embodiment" and implementation" mean "serving as an example, instance, or illustration," and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the description thereof.

It is noted that embodiments of the present disclosure can comprise one or more combinations of two or more of the features described herein. As used herein, "feature(s)" and similar terms can include, for example, one or more compositions, ingredients, components, elements, members, parts, portions, systems, methods, steps, configurations, parameters, properties, or other aspect of the subject matter at hand. Embodiments can include any of the features, options, and/or possibilities set out elsewhere in the present disclosure, including in other aspects or embodiments of the present disclosure. It is also noted that while each of the foregoing, following, and/or other features described herein represents a distinct embodiment of the present disclosure, features can also be combined and/or combinable with another one or more other features in any suitable combination and/or order, with or without one or more additional features included therewith or performed therebetween, to form unique embodiments, each of which is contemplated in the present disclosure. Such combinations of any two or more of such features represent distinct embodiments of the present disclosure. Accordingly, the present disclosure is not limited to the specific combinations of exemplary embodiments described in detail herein and disclosure of certain features relative to a specific embodiment of the present disclosure should not be construed as limiting application or inclusion of said features to the specific embodiment.

In addition, unless a feature is described as being requiring in a particular embodiment, features described in the various embodiments can be optional and may not be included in other embodiments of the present disclosure. Moreover, unless a feature is described as requiring another feature in combination therewith, any feature herein may be combined with any other feature of a same or different embodiment disclosed herein. Likewise, any steps recited in any method described herein and/or recited in the claims can be executed in any suitable order and are not necessarily limited to the order described and/or recited, unless otherwise stated (explicitly or implicitly). Such steps can, however, also be required to be performed in a particular order in certain embodiments of the present disclosure.

As used throughout this application the words "can" and "may" are used in a permissive sense (i.e., meaning having the potential to), rather than the mandatory sense (i.e., meaning must).

The word "or" as used herein means any one member of a particular list and also includes any combination of members of that list.

As used in this specification and the appended claims, the singular forms "a," "an" and "the also contemplate plural referents, unless the context clearly dictates otherwise. Thus, for example, reference to a "moisturizer" includes one, two, or more moisturizers. Similarly, reference to a plurality of referents should be interpreted as comprising a single referent and/or a plurality of referents unless the content and/or context clearly dictate otherwise. Thus, reference to "moisturizers" does not necessarily require a plurality of such moisturizers. Instead, it will be appreciated that independent of conjugation; one or more moisturizers are contemplated herein.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

As used herein, the terms "mixture," "fluid mixture," "liquid mixture," and the like can comprise any suitable composition and/or combination of the specific components thereof. For instance, a fluid or liquid mixture can comprise a solution, suspension, colloid, emulsion, or other mixture of liquid and non-liquid components.

As used herein, the terms "baby wipe(s)," "hand wipe(s)," "sanitary wipe(s)," "cleansing wipe(s)," "wet wipe(s),"

"wipe(s)," and so forth are and/or can be used interchangeably, except where context clearly indicates otherwise.

As used herein, the term "natural" refers to organic products, products derived from plants, minimally processed products generally known to be non-toxic for at least topical applications, and the like.

By "Quantum satis" (also referred to as "q.s." or "qs") is meant the amount that is enough. Accordingly, a component or ingredient "qs 100%," "provided at qs 100%," or "qs to 100%" indicates that the component or ingredient is provided or included in an amount sufficient to complete the composition or to bring the total (of all components, whether recited or not) to 100%. It is noted, however, that a (final) component or ingredient "qs 100%," "provided at qs 100%," or "qs to 100%" does not indicate that the mixture consists of, consists essentially of, or only contains the components listed or recited immediately before the "qs 100%" component. In other words, "qs 100%," and similar terms, is meant to be an open-ended expression indicating the source of the remainder, whatever that remainder may be.

To facilitate understanding, like references (i.e., like naming of components and/or elements) have been used, where possible, to designate like components and/or elements common to the written description and/or figures. Specific language will also be used herein to describe the exemplary embodiments. Nevertheless, it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

The headings used herein are for organizational purposes only and are not meant to be used to limit the scope of the description or the claims.

Illustrative Embodiments

The following description of illustrative embodiments includes disclosure that is relevant to one or more aspects or embodiments of the present disclosure. Accordingly, some embodiments of the present disclosure can include the combination of elements or features disclosed in the following examples. It is noted, however, that various aspects or embodiments of the present disclosure need not, may not, or do not include each and every element or feature disclosed in a particular example. Indeed, certain aspects or embodiments may have fewer than all of the exemplary elements or features disclosed in connection with the following illustrative embodiments without departing from the scope of the present disclosure. In addition, some aspects or embodiments may include one or more elements or features disclosed in a separate aspect or embodiment. In other words, elements or features disclosed in one or more of the following examples can be included and/or incorporated into any one or more of the embodiments disclosed herein.

Disclosed herein are embodiments of natural, disposable baby wipes made with natural, sustainable, environmentally responsible, and/or biodegradable material(s). Specifically, embodiments of the present disclosure include natural, disposable baby wipes made with or from biodegradable (e.g., 100% biodegradable (bamboo) sheet material) and impregnated with a natural cleansing solution. In some embodiments, the natural cleansing solution may include a solvent, one or more preservatives, one or more skin conditioning agents, one or more antioxidants, and one or more astringents.

In some embodiment, the natural disposable wipes may comprise a natural disposable wipe made from 100% biodegradable materials. The biodegradable materials may comprise 100% bamboo fibers. The natural disposable wipes may also include a natural cleansing solution made from, comprising, consisting essentially (or entirely) of natural ingredients. The natural cleansing solution may include a solvent, one or more preservatives, one or more skin conditioning agents, one or more antioxidants, and one or more astringents.

The natural disposable wipe may include a wipe and a natural cleansing solution. The natural disposable wipes may be soaked in a natural cleansing solution. The natural cleansing wipes, or wipes, may be packaged so that they retain moisture and are pre-moistened when a user removes one from the package. In other embodiments, the wipes may be treated with the natural cleansing solution and then dried. In this embodiment, the user would then add moisture, such as water, to the dry wipe to re-activate the natural cleansing solution.

The natural disposable wipe may be comprised of natural materials, preferably, biodegradable materials. Biodegradable materials may comprise 90-100% of the materials forming the natural disposable wipe. Biodegradable materials may include bamboo. Bamboo plants are fast-growing, making them a renewable resource. Bamboo fiber may comprise 90-100% of the materials forming the natural disposable wipe.

In some embodiments, the natural wipe can be formed into a (thin) sheet. In some embodiments, the sheet can be substantially rectangular. The sheet (or wipe) can have a length of (about) 12-18 cm and a width of (about) 10-14 cm. In some embodiments, the sheet (or wipe) may have smaller dimensions, such as a length of (about) 8-12 cm and a width of (about) 6-10 cm. In some embodiments the sheet (or wipe) may have larger dimensions, such as a length of (about) 18-24 cm and a width of (about) 14-18 cm. Thus, baby wipes according to various embodiments of the present disclosure can comprise a sheet material having a length of (about) 8-24 cm and a width of (about) 6-18 cm. A preferred embodiment comprises a sheet (or wipe) having a length of (about) 20 cm and a width of (about) 15 cm. In some embodiments, the sheet (or wipe) can have a thickness of (about) 0.5-3 mm, preferably (about) 1-2 mm or (about) 0.5-1.5 mm, more preferably (about) 1-1.5 mm or (about) 0.5-1 mm.

In some embodiments, the sheet (or wipe) can comprise between 25 and 65 grams, preferably about 40-55 grams, more preferably about 45 grams, of (100% natural) bamboo fibers.

The wipes may be packaged as layered, individual wipes, so that a wipe is not attached to or configured to pull an adjacent wipe. In other embodiments, the wipes may be folded into one another in an alternating pattern so that when a top wipe is removed for use, the wipe below the top wipe is queued for a next use. In another embodiment, the wipes may be attached to one another by way of a perforated edge, wherein the removal of a wipe is achieved by tearing a first wipe along a perforation, thereby separating the first wipe from subsequent wipes. The wipes may be made with different thicknesses depending on the desired effect. For example, some wipes may be thick to provide extra cushion and/or absorption, while other wipes may be thin to make them more lightweight and portable.

The natural cleansing solution for the natural disposable wipes may include a solvent, one or more skin conditioning agents, one or more preservatives, one or more antioxidants, and one or more astringents.

Solvents may be present in the natural cleansing solution to dissolve other ingredients. Solvents may comprise purified water. In some embodiments, the amount of solvent may comprise 80.0-100.0 wt. % of the cleansing solution. In other embodiments, the solvent may comprise 90.0-100.0 wt. % of the cleansing solution.

Preservatives in the natural cleansing solution are natural ingredients added to prevent spoilage of the cleansing solution and to provide an antibacterial element to the natural cleansing solution. Preservatives may comprise 0.50-1.5 wt. % of the natural cleansing solution. Preservatives in the natural cleansing solution may include citric acid, sodium citrate, sodium benzoate, and/or potassium sorbate. Citric acid may comprise 0.01-0.20 wt. % of the natural cleansing solution. Sodium citrate may comprise 0.01-0.15 wt. % of the natural cleansing solution. Sodium benzoate may comprise 0.25-1.25 wt. % of the natural cleansing solution. Potassium sorbate may comprise 0.10-1.0 wt. % of the natural cleansing solution.

Antioxidants are natural substances made up of vitamins and minerals.

Antioxidants may counter free radicals which damage DNA, lipids, and proteins by preventing or slowing the skin's deterioration due to a chemical reaction with oxygen. Antioxidants may also be considered skin conditioning agents. The antioxidants of the natural cleansing solution may include tea tree oil, *Chamomilla Recutita*, and/or Aloe Barbadensis leaf juice. Antioxidants may comprise 0.25-1.0 wt. % of the natural cleansing solution. Tea tree oil may comprise 0.2-0.5 wt. % of the natural cleansing solution. *Chamomilla recutita* may comprise 0.01-0.20 wt. % of the natural cleansing solution. Aloe barbadensis leaf juice may comprise 0.01-0.20 wt. % of the natural cleansing solution.

The natural cleansing solution may include at least one astringent ingredient. Astringents are chemicals that shrink or constrict body tissue, thereby creating a protective layer between the underlying layers of the skin with external elements. Astringents may contain antioxidants able to fight bacteria on the skin and help it to look clean and fresh. Astringents, such as cucumber extract, may comprise 0.01-0.20 of the natural cleansing solution.

In an embodiment, the natural disposable wipes formulation can be specifically formulated to be applied to a skin surface. Illustrative methods (of cleansing skin) can include wiping a selected skin surface are with a baby wipe in accordance with an embodiment of the present disclosure.

Additional properties of certain ingredients described herein (for the natural cleansing solution) are shown below in Table 1:

TABLE 1

| Name | Illustrative Function* |
|---|---|
| Purified Water | Water is used in the formulation of most types of cosmetic and personal care products. Water is primarily used as a solvent to dissolve many of the ingredients that impart skin benefits, such as conditioning agents and cleansing agents. Water also forms emulsions in which the oil and water components of the product are combined to form creams and lotions. Only Water that is free of toxins, pollutants and microbes is used in the formulation of cosmetics and personal care products. Water used for this purpose is also referred to as distilled water, purified water or aqua. |
| Aloe Barbadensis Leaf (Aloe Vera Gel) Juice | This ingredient functions mostly as a skin conditioning agent. |
| Sodium Benzoate | Sodium benzoate occurs naturally along with benzoic acid and its esters in many foods. Fruits and vegetables are rich sources. Other sources include seafood and dairy products. |
| Potassium Sorbate | Potassium sorbate is a potassium salt of sorbic acid, a naturally occurring antimicrobial compound; used as a preservative. |
| Tea Tree Oil | Typically functions as an antioxidant and fragrance ingredient. |
| Cucumber Extract | May function as an astringent and/or skin conditioning agent. |
| Chamomilla Recutita | Function mostly as fragrance ingredients and skin conditioning ingredients in cosmetics. |
| Citric Acid | Typically functions as a pH adjuster, chelating agent, or fragrance ingredient. May also be used as a skin conditioning agent, cosmetic astringent, or cosmetic biocide. |
| Sodium Citrate | Primarily functions as a buffering agent in cosmetics but may be used as a preservative. |

At least one preferred embodiment includes a natural, disposable baby wipe product, preferably for use in cleaning or cleansing skin, preferably sensitive skin area(s), such as baby's bottom, anus, and/or genitals. The natural, disposable baby wipe product can comprise a sheet material impregnated with a cleansing solution.

The sheet material can be biodegradable, in some embodiments. The sheet material can comprise bamboo or a bamboo material, in some embodiments. In some embodiments, the sheet can be formed of, comprise, or consist (essentially or entirely) of biodegradable bamboo fibers or (dried) pulp. In some embodiments, the sheet can comprise or be formed from 100% biodegradable bamboo fibers or pulp. In some embodiments, the sheet can be formed of or consist (essentially or entirely) of 100% biodegradable bamboo fibers or pulp.

The cleansing solution can comprise a mixture of one or more natural, organic, and/or plant-derived ingredients, such as *Aloe vera* (leaf and/or juice) (extract), *Cucumis sativus* (cucumber) (extract), *Chamomilla recutita* (chamomile) oil, citric acid, sodium citrate, tea tree oil, potassium sorbate, sodium benzoate, and water. Each of the foregoing ingredients can be acceptable under the rigid standard of the prestigious SkinSAFE group (in appropriate amount(s), for some ingredients). Some embodiments can include or comprise each of the foregoing ingredients. Some embodiments can consist or consist essentially of each of the foregoing ingredients. Alternative embodiments can include or comprise fewer than all of the foregoing ingredients. Some embodiments can include or comprise a combination of two or more of the foregoing ingredients.

In some embodiments, the cleansing solution (i) consists (essentially) of certified natural and/or organic ingredients or (ii) is devoid of synthetic ingredients that negate natural certification. In some embodiments, the cleansing solution can include (trace amount(s) of) one or more non-natural or synthetic ingredients, while still maintaining certified status. For instance, various natural ingredient extraction processes use chemicals that remain (in trace amounts) in the final, extracted plant product. Other naturally occurring, plant-based compounds are processed or altered during extraction, formulation, or processing, thereby becoming (technically) a non-natural compound. Moreover, a small amount of one or more non-natural or synthetic ingredient(s) may be included in one or more embodiments (e.g., preservatives, solvents, conditioning agents, etc.). Certification (e.g., as "natural" or "organic") may not be negated by such ingredients being included in compositions of the present disclosure.

In some embodiments, the cleansing solution can include (about) 0.01-2%, w/w, *Aloe vera* (leaf and/or juice) (extract), preferably about 0.1%, w/w, *Aloe vera* (leaf and/or juice) (extract).

In some embodiments, the cleansing solution can include (about) 0.01-2%, w/w, *Cucumis sativus* (cucumber) (extract), preferably about 0.1%, w/w, *Cucumis sativus* (cucumber) (extract).

In some embodiments, the cleansing solution can include (about) 0.01-2%, w/w, *Chamomilla recutita* (chamomile) oil, preferably about 0.1%, w/w, *Chamomilla recutita* (chamomile) oil.

In some embodiments, the cleansing solution can include (about) 0.01-1%, w/w, citric acid, preferably about 0.08%, w/w, citric acid.

In some embodiments, the cleansing solution can include (about) 0.01-1%, w/w, sodium citrate, preferably about 0.05%, w/w, sodium citrate.

In some embodiments, the cleansing solution can include (about) 0.05-2%, w/w, potassium sorbate, preferably about 0.45%, w/w, potassium sorbate. Some embodiments may be (substantially) free or devoid of potassium sorbate.

In some embodiments, the cleansing solution can include (about) 0.05-2%, w/w, tea tree oil, preferably about 0.3%, w/w, tea tree oil. Some embodiments may be (substantially) free or devoid of tea tree oil.

In some embodiments, the cleansing solution can include (about) 0.05-2%, w/w, sodium benzoate, preferably about 0.5%, w/w, sodium benzoate. Some embodiments may be (substantially) free or devoid of sodium benzoate.

In some embodiments, the cleansing solution can include water, preferably purified water, q.s. to 100%.

Each of the foregoing ingredients can be acceptable under the rigid standard of the prestigious SkinSAFE group (in the stated amounts). Some embodiments can include or comprise each of the foregoing ingredients. Some embodiments can consist or consist essentially of each of the foregoing ingredients. Alternative embodiments can include or comprise fewer than all of the foregoing ingredients. Some embodiments can include or comprise a combination of two or more of the foregoing ingredients.

Deodorizing Properties: Bamboo fibers naturally have anti-bacterial properties to fight odor-causing bacteria.

Luxuriously soft: Bamboo fibers are super soft. They are organically smooth and round without chemical treatment, meaning no sharp spurs or harsh chemicals that may irritate the baby's skin.

No chemical pesticides: Grows without the need for irrigation, pesticides, or fertilizers.

Bamboo is naturally hypoallergenic, making it perfect for sensitive skin at any age.

In some embodiments, the wipes can be (substantially) free or devoid of one or more (e.g., all or any) irritating ingredients.

In some embodiments, the wipes can be (substantially) free or devoid of one or more (e.g., all or any) ingredients known to irritate a baby's sensitive skin.

In some embodiments, the wipes can be (substantially) free or devoid of one or more (e.g., all or any) ingredients that have been linked to allergic dermatitis.

In some embodiments, the wipes can be (substantially) free or devoid of one or more (e.g., all or any) artificial fragrances.

In some embodiments, the wipes can be (substantially) free or devoid of one or more (e.g., all or any) controversial preservatives.

In some embodiments, the wipes can be (substantially) free or devoid of one or more (e.g., all or any) artificial preservatives.

In some embodiments, the wipes can be (substantially) free or devoid of PABA.

In some embodiments, the wipes can be (substantially) free or devoid of petroleum.

In some embodiments, the wipes can be (substantially) free or devoid of parabens.

In some embodiments, the wipes can be (substantially) free or devoid of phthalates.

In some embodiments, the wipes can be (substantially) free or devoid of methylisothiazolinone.

In some embodiments, the wipes can be (substantially) free or devoid of methylchloroisothiazolinone.

In some embodiments, the wipes can be (substantially) free or devoid of tea tree oil.

In some embodiments, the wipes can be (substantially) free or devoid of lemongrass.

CONCLUSIONS

*Cosmetic Use: The Cosmetic Ingredient Review (CIR) Expert Panel assesses the safety of cosmetic ingredients based on the expected use of these ingredients in cosmetics. The Panel reviews data received from the U.S. Food and Drug Administration (FDA) and the cosmetics industry to determine the expected cosmetic use. The FDA collects data from manufacturers on the use of individual ingredients in cosmetics, by cosmetic product category, through the FDA Voluntary Cosmetic Registration Program (VCRP). Data from the cosmetic industry are submitted in response to a survey of the maximum reported use concentrations, by category, conducted by the Personal Care Products Council.

The disclosed and/or described embodiments are to be considered in all respects only as illustrative and not restrictive. While various aspects, features and embodiments have been disclosed herein, other aspects, features and embodiments are contemplated but may not be disclosed. For instance, certain well-known aspects, features and embodiments are not described herein in particular detail in order to avoid obscuring aspects of the described embodiments. Such aspects, features and embodiments are, however, contemplated herein. Thus, while a number of methods and components similar or equivalent to those described herein can be used to practice embodiments of the present disclosure, only certain components and methods are described herein.

The present disclosure may also be embodied in other specific forms without departing from its spirit or essential characteristics. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. For instance, various alterations and/or modifications and additional applications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure.

It will be appreciated that certain embodiments (e.g., compositions, formulations, method, etc.) may include, incorporate, or otherwise comprise features (e.g., properties, components, ingredients, elements, parts, portions, steps, etc.) described in other embodiments disclosed and/or described herein. Accordingly, the various features of certain embodiments can be compatible with, combined with, included in, and/or incorporated into other embodiments of the present disclosure. Thus, disclosure of certain features relative to a one embodiment of the present disclosure should not be construed as limiting application or inclusion of said features to the specific embodiment. Rather, it will be appreciated that other embodiments can also include said features without necessarily departing from the scope of the present disclosure. Moreover, unless a feature is described as requiring another feature in combination therewith, any feature herein may be combined with any other feature of a same or different embodiment disclosed herein.

The scope of the invention is, therefore, indicated by the appended claims rather than by the foregoing description. All changes which come within the meaning and range of equivalency of the claims are to be embraced within their scope.

What is claimed is:

1. A disposable baby wipe product, comprising:

a sheet material comprised of biodegradable bamboo fibers; and a cleansing solution, comprising *Aloe vera* extract, *Cucumis sativus* extract, *Chamomilla recutita* oil, citric acid, sodium citrate, tea tree oil, potassium sorbate, sodium benzoate, and water, the sheet material being impregnated with the cleansing solution.

2. The product of claim 1, wherein the sheet material has a rectangular configuration, measuring approximately 15 cm×20 cm×1 mm.

3. The product of claim 1, wherein the cleansing solution comprises:

0.01-2%, w/w, *Aloe vera* extract;
0.01-2%, w/w, *Cucumis sativus* extract;
0.01-2%, w/w, *Chamomilla recutita* oil;
0.01-1%, w/w, citric acid;
0.01-1%, w/w, sodium citrate;
0.05-2%, w/w, potassium sorbate;
0.05-2%, w/w, tea tree oil;
0.05-2%, w/w, sodium benzoate; and
waterq.s. to 100%.

4. A disposable baby wipe product, comprising:

a natural disposable wipe wherein the natural disposable wipe is comprised of biodegradable materials; and wherein the natural disposable wipes is presoaked in a natural cleansing solution,the natural cleansing solution comprising:

a solvent;
one or more skin conditioning agents;
one or more preservatives, wherein the one or more preservatives include sodium benzoate, potassium sorbate, sodium citrate, and citric acid;
one or more antioxidants; and
one or more astringents;

wherein all of the ingredients of the natural cleansing solution are derived from natural sources.

5. The natural disposable wipes of claim 4, wherein the natural disposable wipe comprises a sheet material comprised of bamboo.

6. The natural disposable wipes of claim 4, wherein the solvent includes purified water.

7. The disposblae baby wipe product of claim 4, wherein the one or more skin conditioning agents is selected from the group consisting of Cucumis sativus extract, *Chamomilla Recutita* oil or extract, *Aloe Barbadensis* leaf juice or extract, and combinations thereof.

8. The disposblae baby wipe product of claim 4, wherein the one or more antioxidants is selected from the group consisting of tea tree oil, *Chamomilla Recutita* oil or extract, and *Aloe Barbadensis* leaf juice or extract, *Cucumis sativus* extract, citric acid, and combinations thereof.

9. The disposblae baby wipe product of claim 4, wherein the one or more astringents is *Cucumis sativus* extract.

10. A natural disposable wipes, comprising:

a sheet comprised of biodegradable material, wherein the biodegradable material(s) comprises bamboo fiber; and a natural cleansing solution, the natural cleansing solution comprising:

a solvent;
one or more skin conditioning agents;
one or more preservatives, wherein the one or more preservatives include sodium benzoate, potassium sorbate, sodium citrate, and citric acid;
one or more antioxidants; and
one or more astringents;

wherein all of the ingredients of the natural cleansing solution are derived from natural sources; and wherein the natural disposable wipe is presoaked in the natural cleansing solution and packaged to retain moisture.

11. The natural disposable wipes of claim 10, wherein the solvent includes purified water.

12. The natural disposable wipes of claim 10, wherein the one or more skin conditioning agents is selected from the group consisting of *Cucumis sativus* extract, *Chamomilla Recutita* oil or extract, and *Aloe Barbadensis* leaf juice or extract, and combinations thereof.

13. The natural disposable wipes of claim 10, wherein the one or more antioxidants is selected from the group consisting of tea tree oil, *Charmomilla Recutita* oil or extract, and *Aloe Barbadensis* leaf juice or extract, Cucumis sativus extract, citric acid, and combinations thereof.

14. The natural disposable wipes of claim 10, wherein the one or more astringents is *Cucumis sativus* extract.

15. The natural disposable wipes of claim 10, wherein the natural cleansing solution comprises Aloe vera extract, *Cucumis sativus* extract, *Chamomilla recutita* oil, citric acid, sodium citrate, tea tree oil, potassium sorbate, sodium benzoate, and water.

16. The natural disposable wipes of claim 15, wherein the cleansing solution comprises:

0.01-2%, w/w, *Aloe vera* extract;
0.01-2%, w/w, *Cucumis sativus* extract;
0.01-2%, w/w, *Chamomilla recutita* oil;
0.01-1%, w/w, citric acid;
0.01-1%, w/w, sodium citrate;
0.05-2%, w/w, potassium sorbate;
0.05-2%, w/w, tea tree oil;
0.05-2%, w/w, sodium benzoate; and
water, q.s. to 100%.

17. The disposable baby wipe product of claim 16, wherein the sheet comprises 100% biodegradable bamboo fiber.

18. The disposable baby wipe product of claim 4, wherein the natural cleansing solution comprises *Aloe vera* extract, *Cucumis sativus* extract, *Chamomilla recutita* oil, citric acid, sodium citrate, tea tree oil, potassium sorbate, sodium benzoate, and water.

19. The disposable baby wipe product of claim 18, wherein the cleansing solution comprises:

0.01-2%, w/w, *Aloe vera* extract;
0.01-2%, w/w, *Cucumis sativus* extract;
0.01-2%, w/w, *Chamomilla recutita* oil;
0.01-1%, w/w, citric acid;
0.01-1%, w/w, sodium citrate;
0.05-2%, w/w, potassium sorbate;
0.05-2%, w/w, tea tree oil;
0.05-2%, w/w, sodium benzoate; and
water, q.s. to 100%.

20. The natural disposable wipes of claim 19, wherein the biodegradable material comprises 100% biodegradable bamboo fibers.

* * * * *